US012791030B2

(12) United States Patent
Wu et al.

(10) Patent No.: US 12,791,030 B2
(45) Date of Patent: Nov. 10, 2026

(54) FLUID PUMP

(71) Applicant: JOHNSON ELECTRIC INTERNATIONAL AG, Murten (CH)

(72) Inventors: Chunfa Wu, Shen Zhen (CN); Xiaohui Wang, Shen Zhen (CN); Hongguang Li, Shen Zhen (CN); Muyang Li, Shen Zhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 19/241,251

(22) Filed: Jun. 17, 2025

(65) Prior Publication Data

US 2025/0320873 A1 Oct. 16, 2025

Related U.S. Application Data

(63) Continuation of application No. PCT/CN2024/087788, filed on Apr. 15, 2024.

(51) Int. Cl.
*F04D 13/06* (2006.01)
*F04D 1/00* (2006.01)
*F04D 29/046* (2006.01)

(52) U.S. Cl.
CPC ..... *F04D 13/06* (2013.01); *F04D 1/00* (2013.01); *F04D 29/046* (2013.01)

(58) Field of Classification Search
CPC ..... F04D 13/06; F04D 1/00; F04D 29/046; F04D 13/0606; F04D 29/628;
(Continued)

(56) References Cited

U.S. PATENT DOCUMENTS 3,589,827 A * 6/1971 Gerasimenko ..... F04D 29/2266 417/365
5,009,578 A * 4/1991 Hyland ..... F04D 29/0416 417/370

(Continued)

FOREIGN PATENT DOCUMENTS

CN 113530839 A 10/2021
CN 113653651 A 11/2021

(Continued)

OTHER PUBLICATIONS

International Search Report of Corresponding PCT Application No. PCT/CN2024/087788 with Machine Translation Jan. 9, 2025.

*Primary Examiner* — Dominick L Plakkoottam
(74) *Attorney, Agent, or Firm* — Aird & Berlis LLP

(57) ABSTRACT

A fluid pump includes a pump casing, an impeller arranged in the pump casing and a motor for driving the impeller to rotate in the pump casing. The pump casing includes a sleeve arranged therein and dividing an internal space of the pump casing into a first space and a second space. The motor includes a stator, and a rotor fixedly connected to the impeller through a rotating shaft. The rotor, the rotating shaft and the impeller are movably arranged in the first space, and the stator is fixedly arranged in the second space. A first bearing assembly and a second bearing assembly are respectively arranged at two ends of the rotating shaft. The second bearing assembly is positioned at one end of the sleeve far away from the impeller and fixedly connected to the sleeve by a fixing member.

17 Claims, 7 Drawing Sheets

(58) Field of Classification Search
CPC .... F04D 13/0633; F04D 13/026; F16C 35/02; F16C 35/04; F16C 35/042; F16C 35/06; F16C 35/063; F16C 35/07; F16C 35/077; F16C 2360/42; F16C 2360/43; F16C 2360/44; F16C 2360/45; F16C 2360/46
See application file for complete search history.

(56) References Cited

U.S. PATENT DOCUMENTS

| | | | | | |
|---|---|---|---|---|---|
| 5,129,795 | A * | 7/1992 | Hyland | H02K 7/09 | 417/423.12 |
| 5,385,454 | A * | 1/1995 | Kobayashi | H02K 5/128 | 417/423.12 |
| 10,323,642 | B2 * | 6/2019 | Weiske | F04D 29/046 | |
| 11,371,522 | B2 * | 6/2022 | Xie | F04D 29/043 | |
| 11,802,565 | B2 * | 10/2023 | Wei | H02K 9/19 | |
| 2011/0156542 | A1 * | 6/2011 | Miura | H02K 5/1732 | 310/425 |
| 2014/0312727 | A1 * | 10/2014 | Shinosaka | H02K 5/1732 | 310/90 |
| 2015/0132109 | A1 * | 5/2015 | Sumimoto | F04D 19/042 | 415/119 |
| 2018/0262077 | A1 * | 9/2018 | Zanghelini | H02K 5/15 | |
| 2020/0191151 | A1 * | 6/2020 | Svarre | F04D 29/046 | |
| 2020/0191166 | A1 * | 6/2020 | Svarre | F04D 29/026 | |
| 2022/0364561 | A1 * | 11/2022 | Verrelst | F04C 18/16 | |

FOREIGN PATENT DOCUMENTS

| | | | | |
|---|---|---|---|---|
| CN | 217539033 | U | 10/2022 | |
| CN | 218717549 | U | 3/2023 | |
| CN | 220890583 | U | 5/2024 | |
| WO | WO-2022254959 | A1 * | 12/2022 | F16C 33/08 |

* cited by examiner

FLUID PUMP

CROSS REFERENCE TO RELATED APPLICATIONS

This non-provisional patent application is continuation application of PCT Application No. PCT/CN2024/087788, filed with the Chinese Patent Office on Apr. 15, 2024, which is incorporated by reference herein in its entirety.

FIELD OF THE INVENTION

The present application relates to the field of pump technology, in particular to fluid pumps.

BACKGROUND OF THE INVENTION

A Pump is usually connected in series in a pipeline and is used to transport fluids such as water, coolant, gas, etc., such as in the thermal management system of electric vehicle chargers, to deliver fluids to cool batteries or cables, etc.

In the existing structure, a pump is generally made up of a pump casing, an impeller arranged in the pump casing and a motor that drives the impeller to rotate in the pump casing, wherein the motor includes a stator and a rotor rotatable relative to the stator, and the rotor is connected to the impeller to drive the impeller to rotate. In order to avoid the fluid from affecting the electrical safety of the motor, the stator and the rotor are separated by a sleeve, in which the stator surrounds the outside of the sleeve, a shaft is fixed to an inner centre of the sleeve, and the rotor and impeller are rotatably sleeved on the shaft.

Because the structure of the shaft is similar to a cantilever beam structure, during the rotation of the impeller, due to the uneven force in the circumferential direction, especially when the fluid, such as the coolant contains a high proportion of air, the shaft may produce a certain degree of deflection, which not only affects the stability of the impeller rotation, but could also cause damage to the components due to the stress at the fixed end of the shaft, which affects the safety of use.

SUMMARY OF THE INVENTION

In view of this, it is necessary to provide a fluid pump that can effectively improve the stability and safety of its operation.

For this reason, one aspect of the present invention provides a fluid pump including a pump casing, an impeller arranged in the pump casing and a motor for driving the impeller to rotate in the pump casing. The pump casing includes a sleeve arranged therein and dividing an internal space of the pump casing into a first space and a second space. The motor includes a stator, and a rotor fixedly connected to the impeller through a rotating shaft. The rotor, the rotating shaft and the impeller are movably arranged in the first space, and the stator is fixedly arranged in the second space. A first bearing assembly and a second bearing assembly are respectively arranged at two ends of the rotating shaft. The second bearing assembly is positioned at one end of the sleeve far away from the impeller and fixedly connected to the sleeve by a fixing member.

The fluid pump may present one or several of the following aspects either solely or in combination.

Optionally, the sleeve is a cylindrical structure with an open end and a closed end, and the second bearing assembly is received in the sleeve and located at the closed end of the sleeve.

Optionally, the second bearing assembly includes a second bearing holder and a second bearing, the second bearing holder includes an inner ring and an outer ring surrounding the inner ring, the second bearing is arranged within the inner ring.

Optionally, the inner ring is axially spaced from the closed end of the sleeve, and the outer ring axially abuts against the closed end of the sleeve.

Optionally, wherein the second bearing holder further includes a plurality of ribs connected between the inner ring and the outer ring, the ribs are arranged at intervals in the circumferential direction, forming channels between adjacent ribs.

Optionally, the rotating shaft is axially spaced from the closed end of the sleeve, and an axially extending flow passage is formed in the rotating shaft.

Optionally, ends of the rotating shaft and the inner ring facing the closed end of the sleeve are substantially flush.

Optionally, the fixing member is fixedly connected to an inner circumferential wall of the sleeve and positions the second bearing holder at the closed end of the sleeve.

Optionally, the fixing member comprises a first ring part and a second ring part, the first ring part is fixedly connected to the inner circumferential wall of the sleeve, and the second bearing holder is axially sandwiched between the second ring part and the closed end of the sleeve.

Optionally, the fixing member further comprises at least one positioning piece extending axially from the first ring part towards the second bearing holder, an outer wall of the second bearing holder is provided with at least one axially extending positioning groove, the at least one positioning piece engages in the at least one positioning groove, to circumferentially position the second bearing holder.

Optionally, the first ring part is fixedly connected to the inner circumferential wall of the sleeve through interference fitting or by welding.

Optionally, the numbers of the positioning piece and the positioning groove are multiple, the multiple positioning pieces and positioning grooves are respectively distributed at intervals along circumferential directions of the first ring part and the second bearing holders.

Optionally, the first bearing assembly comprises a first bearing holder and a first bearing disposed within the first bearing holder, the first bearing holder is stacked on an outer side of the open end of the sleeve, dividing the first space into a first subspace and a second subspace, the impeller is arranged in the first subspace, and the rotor is arranged in the second subspace, the first bearing holder is provided with through holes, which communicates the first subspace with the second subspace.

In another aspect, the present invention provides a fluid pump including a pump casing, an impeller and a motor for driving the impeller to rotate. The pump casing includes a sleeve arranged therein. The sleeve includes an open end and a closed end and divides an internal space of the pump casing into a first space and a second space. The impeller is rotatably arranged in the first space adjacent to the open end of the sleeve. The motor includes a stator fixedly arranged in the second space, and a rotor rotatably arranged in the first space and fixedly connected to the impeller through a rotating shaft, the rotating shaft comprising an axial extending flow passage. Two ends of the rotating shaft are respectively supported by a first bearing assembly and a second bearing assembly. The second bearing assembly is positioned at the closed end of the sleeve and defines channels communicating with the flow passage and the first space.

Optionally, the second bearing assembly comprises a second bearing holder and a second bearing, the second bearing holder comprises an inner ring and an outer ring surrounding the inner ring, the second bearing is arranged within the inner ring, the inner ring is axially spaced from the closed end of the sleeve, and the outer ring axially abuts against the closed end of the sleeve.

Optionally, the inner ring is connected to the outer ring by a plurality of ribs, each two adjacent ribs define one of the channels therebetween.

Optionally, the rotating shaft is axially spaced from the closed end of the sleeve, ends of the rotating shaft and the inner ring facing the closed end of the sleeve are substantially flush.

Optionally, a fixing member is fixedly connected to an inner circumferential wall of the sleeve and secures the second bearing holder at the closed end of the sleeve.

Optionally, the fixing member comprises a first ring part and a second ring part, the first ring part is fixedly connected to the inner circumferential wall of the sleeve, and the second bearing holder is axially sandwiched between the second ring part and the closed end of the sleeve.

Optionally, the fixing member further comprises at least one positioning piece extending axially from the first ring part towards the second bearing holder, an outer wall of the second bearing holder is provided with at least one axially extending positioning groove, the at least one positioning piece engages in the at least one positioning groove, to circumferentially position the second bearing holder.

Compared with existing technology, the fluid pump provided in the application separates the motor stator from the motor rotor and the impeller through a sleeve, so as to avoid the fluid eroding the stator and affecting electrical safety. The rotor is fixedly connected to the impeller through a shaft, and the two ends of the shaft are respectively equipped with a first bearing assembly and a second bearing assembly, so that the two ends of the shaft can be effectively supported and avoid deflection, and the impeller can rotate smoothly even under uneven circumferential forces, thereby improving the stability and safety of the operation of the fluid pump.

DETAILED DESCRIPTION OF THE PREFERRED EMBODIMENTS

Figure 1:
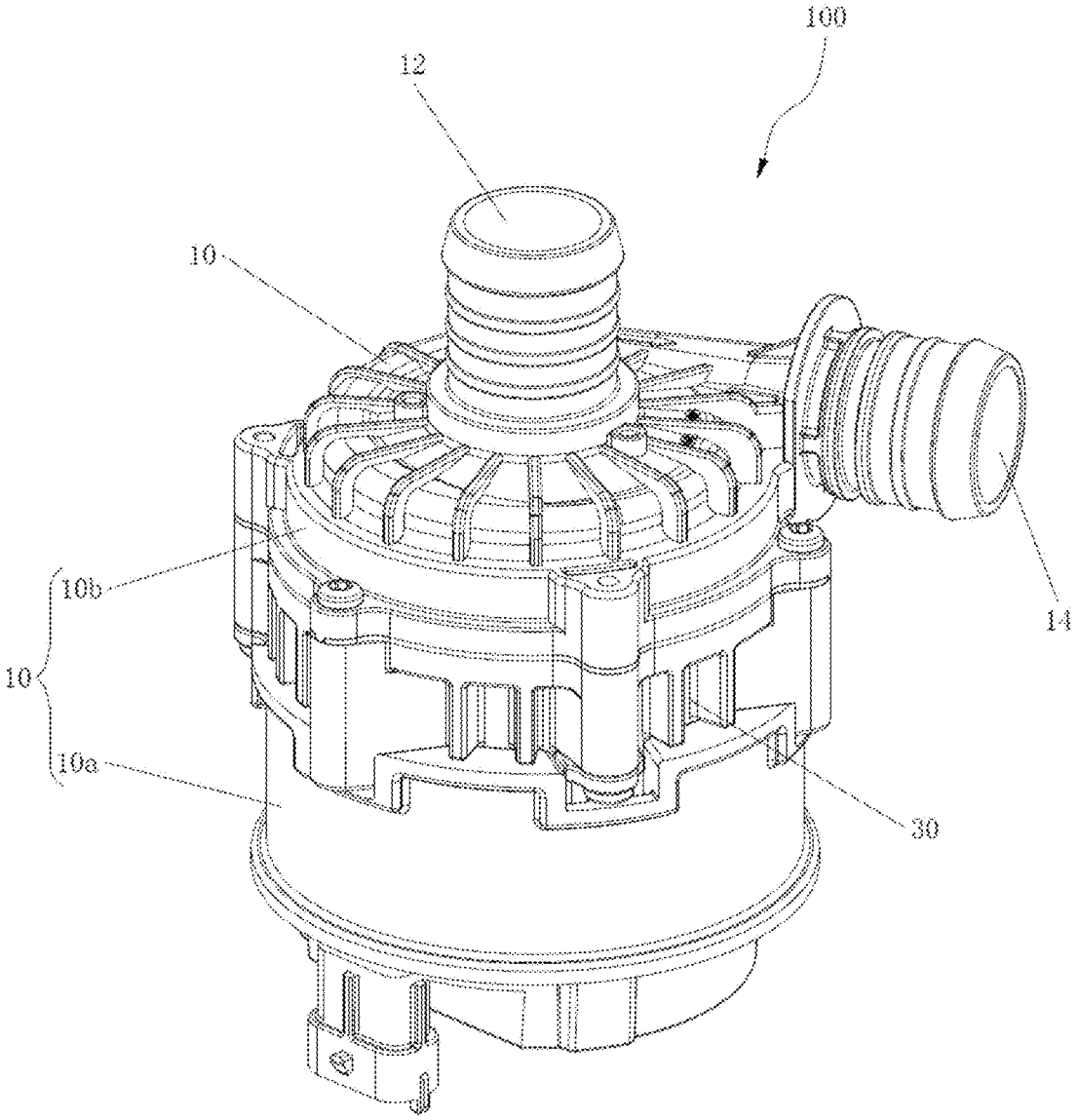
FIG. 1 is a perspective view of an embodiment of the fluid pump of the present application.

In order to facilitate the understanding of the present application, a more comprehensive description of the application is provided below with reference to the relevant drawings. One or more embodiments of the present application are given in the accompanying drawings illustratively, so as to make the understanding of the technical solution disclosed in the present application more accurate and thorough. It should be understood, however, that the present application may be realized in a number of different forms and is not limited to the embodiments described below.

The same or similar numbers in the drawings of the present application correspond to the same or similar parts. In the description of the present application, it is understood that if the terms "upper", "lower", "left", "right", etc., indicate an orientation or positional relationship based on the orientation or positional relationship shown in the drawings. It is only for the convenience of describing the present application and simplifying the description, and does not indicate or imply that the device or element referred to must have a particular orientation, be constructed and operated in a particular orientation. Therefore, the terms describing the positional relationship in the drawings are for illustrative purposes only and cannot be construed as limiting the present application. For those of ordinary skill in the art, the specific meaning of the above terms can be understood on a case-by-case basis.

In addition, if there are descriptions involving "first", "second", etc., in the embodiments of the present application, the descriptions of "first", "second", etc., are only for descriptive purposes and cannot be construed as indicating or implying their relative importance or implying the number of technical features indicated. Thus, the features that are defined as "first" and "second" may explicitly or implicitly include at least one of these features. In addition, if the words "and/or" or "and/or" appear in the whole text, the meaning includes three parallel options, taking "A and/or B" as an example, including the A plan, or the B plan, or the plan A and B meet at the same time.

In addition, the technical solutions between the various embodiments may be combined with each other, but only on the basis that they can be realized by a person skilled in the art. When the combination of technical solutions contradicts or cannot be realized, it shall be deemed that the combination of such technical solutions does not exist and is not within the scope of protection claimed in the present application.

Figure 2:
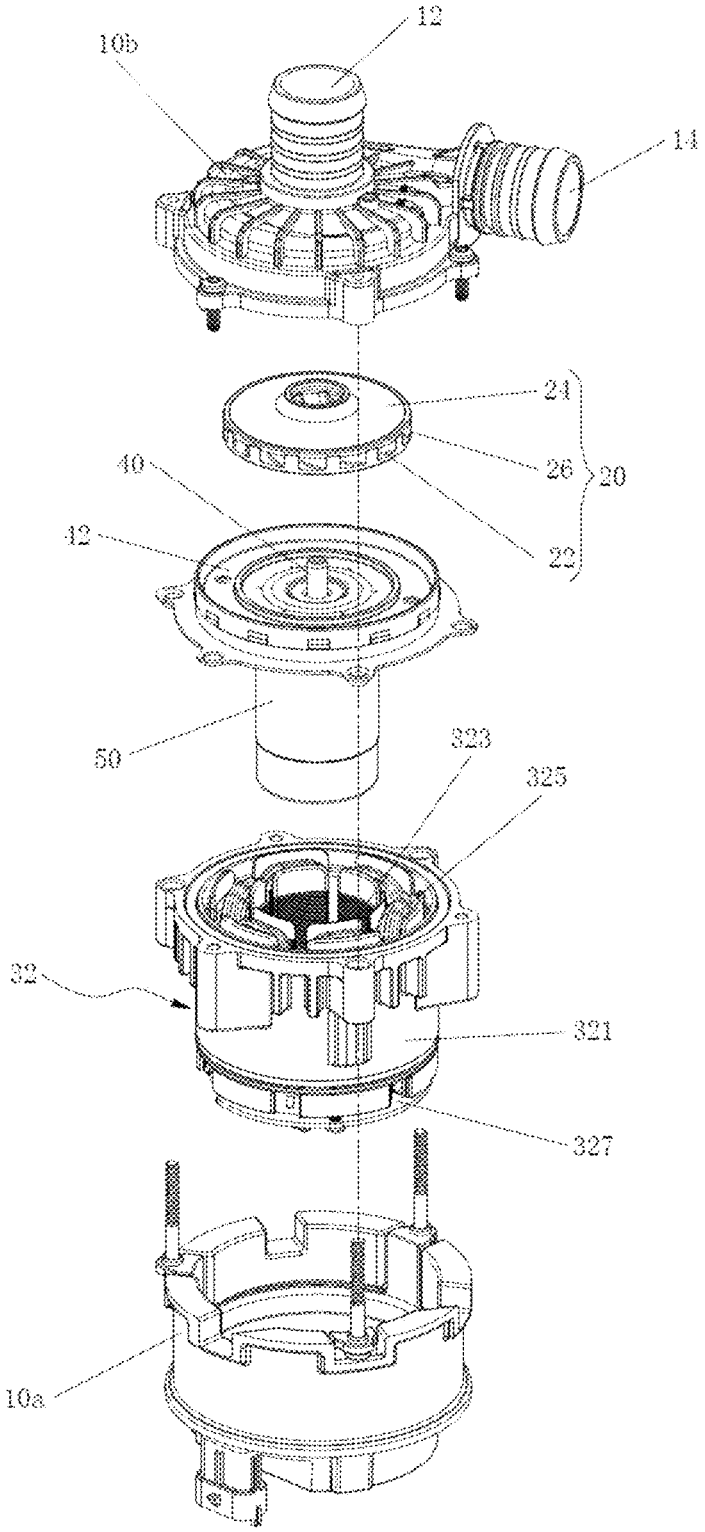
FIG. 2 is an exploded view of the fluid pump of FIG. 1.
Figure 3:
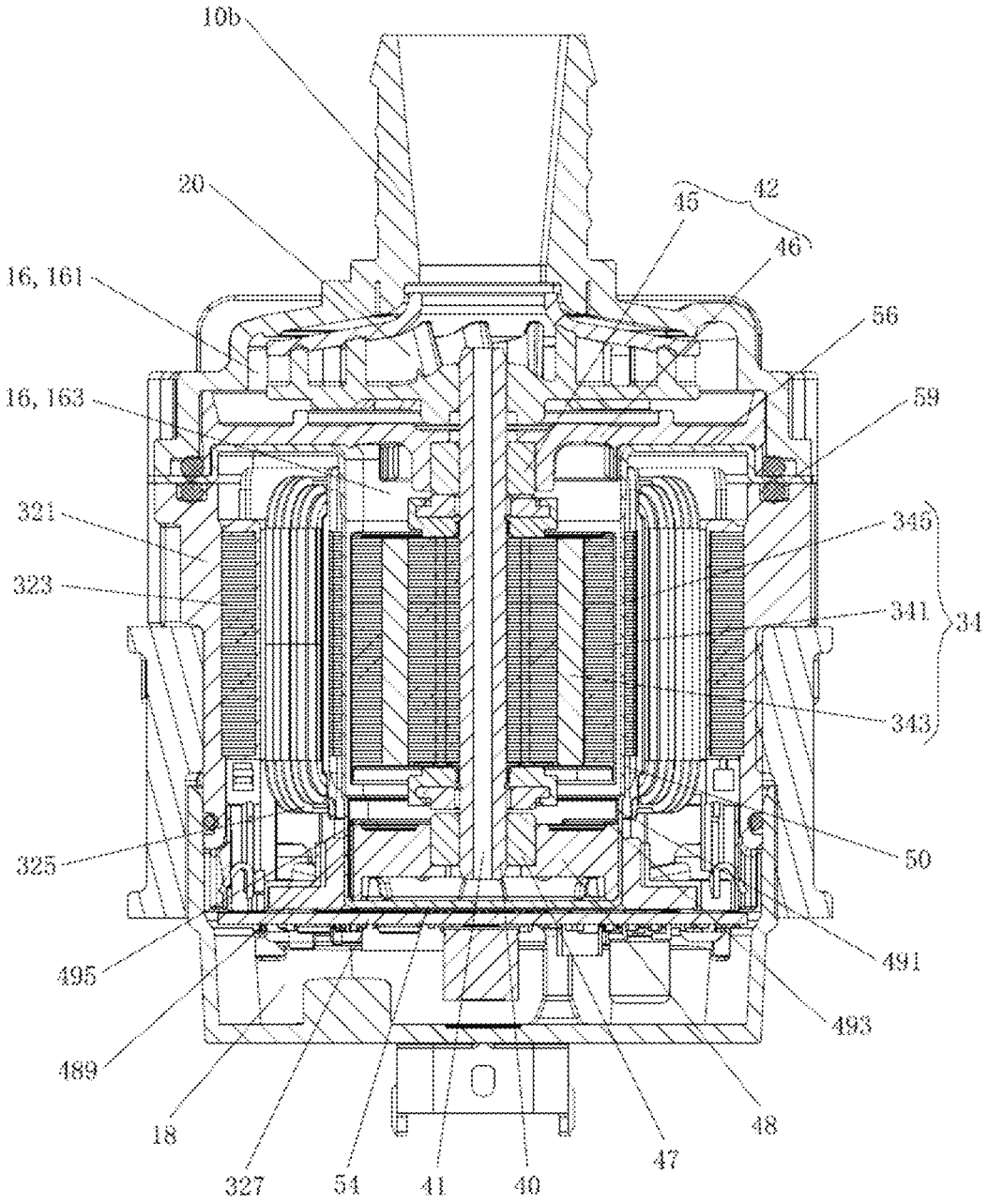
FIG. 3 is an axial cross-sectional view of the fluid pump of FIG. 1.

The present application provides a fluid pump for driving fluids, such as water, coolant, etc., to flow in a pipeline. FIGS. 1-3 show a specific embodiment of the fluid pump of the present application. The fluid pump 100 includes a pump casing 10, an impeller 20 arranged in the pump casing 10 and a motor 30 that drives the impeller 20 to rotate in the pump casing 10.

As shown in FIGS. 1-2, the pump casing 10 comprises a pump casing body 10*a* and a pump casing cover 10*b* fitting with the pump casing body 10*a*, wherein the impeller 20 is received in the pump casing cover 10*b*, and the motor 30 is received in the pump casing body 10*a*.

The pump casing cover 10*b* is provided with an inlet 12 and an outlet 14, which are respectively used for being connected to external pipelines to form a flow path of fluid. In the illustrated embodiment, the inlet 12 extends along an axial direction of the pump casing cover 10*b*, and the outlet 14 extends tangentially along an outer peripheral surface of the pump casing cover 10*b*, and the two are roughly perpendicular to each other. After the fluid enters the pump casing 10 through the inlet 12, it is accelerated and pressurized under the effect of the rotating impeller 20, with a change in flow direction, and is discharged from the pump casing 10 through the outlet 14. In other embodiments, the position, direction, etc. of the inlet 12 and the outlet 14 of the pump casing 10 can be adjusted as needed, and the number of outlets 14 and/or the inlets 12 may also be plurality, and is not limited to the specific embodiment.

The impeller 20 is disc-shaped as a whole, and its outer diameter is slightly smaller than an inner diameter of the pump casing cover 10*b*, and the two form a gap therebetween in the radial direction after assembly, so that the impeller 20 can rotate freely in the pump casing 10. In this embodiment, the impeller 20 includes a base plate 22 and a cover plate 24 arranged at relative intervals, and a plurality of blades 26 are formed between the base plate 22 and the cover plate 24. Preferably, the blades 26 and the base plate 22 are integrally formed through injection moulding, etc., and the cover plate 24 is connected to the base plate 22 through snap-fit mechanism or other means. In some embodiments, the cover plate 24 and the base plate 22 may also be connected together by ultrasonic welding or bonding. In some embodiments, the cover plate 24 and the base plate 22 may also be an integral single structure.

The motor 30 is preferably an inner rotor motor, including a stator 32 and a rotor 34 rotatably arranged in the stator 32. Wherein, the rotor 34 is connected to the impeller 20 through a rotating shaft 40, so that the motor 30 can drive the impeller 20 to rotate.

As shown in FIG. 2, the stator 32 includes a stator shell 321, a stator core 323 arranged in the stator shell 321, a coil 325 wound around the stator core 323 and a circuit board 327 electrically connected to the coil 325, wherein the circuit board 327 is used for connecting to an external power source to supply power to the motor 30. As shown in FIG. 3, the rotor 34 includes a rotor core 341, permanent magnets 343 and a rotor shell 345 that encloses the rotor core 341 and the permanent magnets 343. In this embodiment, a rotor core 341 is provided with assembly holes, and the permanent magnets 343 are embedded within the assembly holes of the rotor core 341 to form an IPM motor as a whole. In some embodiments, the permanent magnets 343 may also be affixed to the outer peripheral surface of the rotor core 341 to form an SPM motor as a whole.

Figure 6:
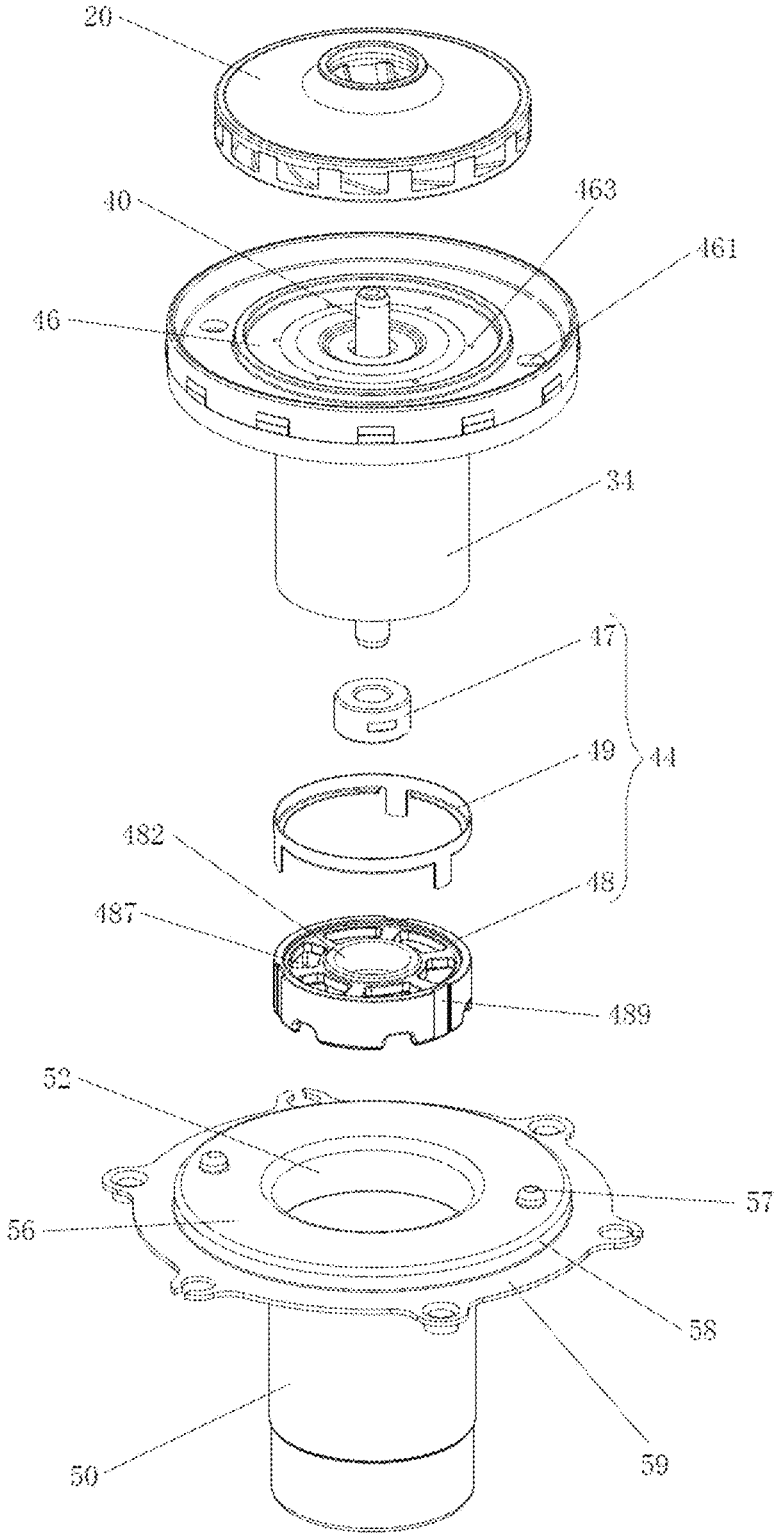
FIG. 6 is an exploded view of FIG. 4.
Figure 7:
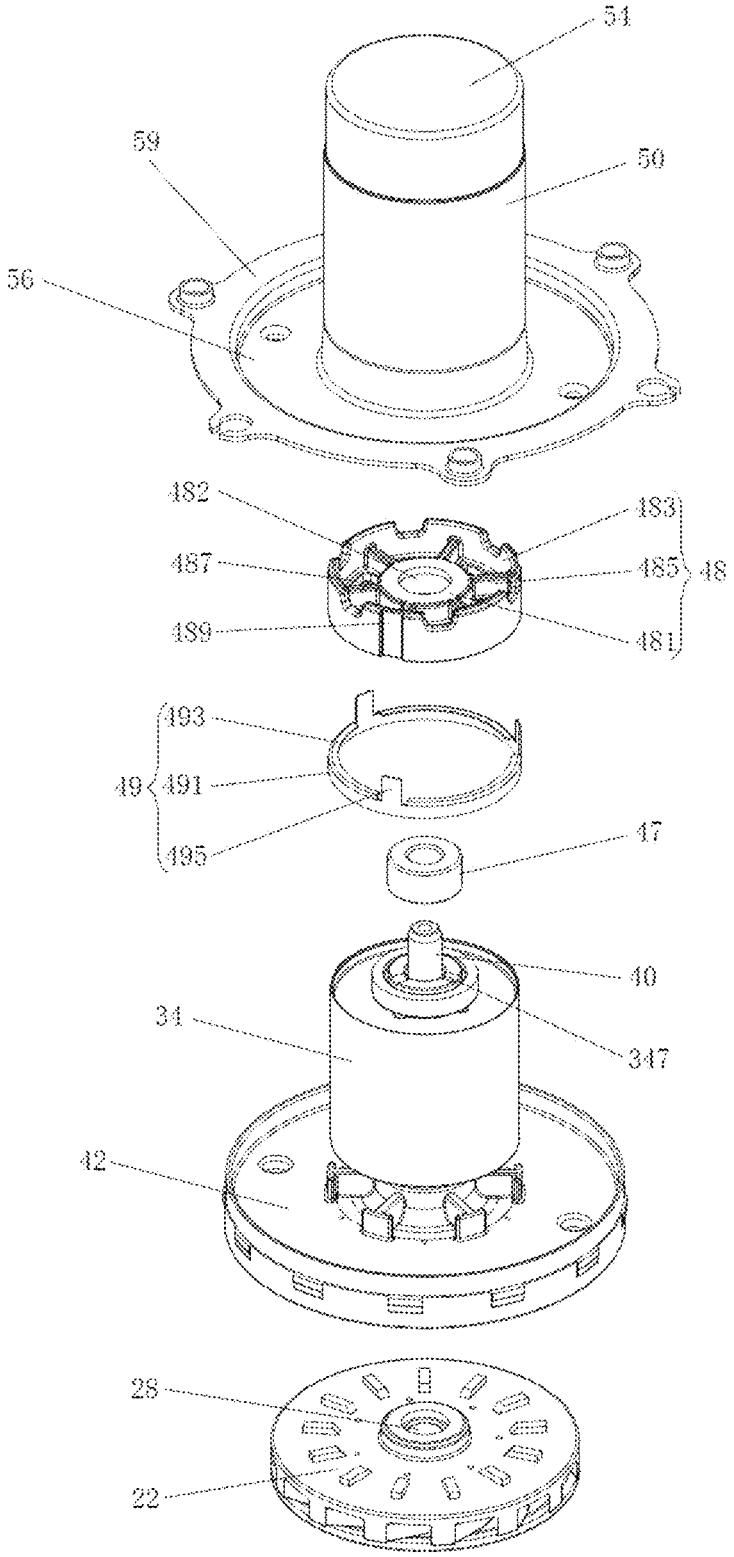
FIG. 7 is another perspective view of FIG. 6.

After the motor 30 is started, the circuit board 327 provides current to the coil 325 and controls the direction and magnitude of the current in the coil 325, allowing the stator 32 to generate a periodically varying rotating magnetic field. The magnetic field interacts with a magnetic field established by the permanent magnets 343 of the rotor 34, drives the rotor 34 to rotate continuously, and then drives the impeller 20 to rotate to promote the fluid flow. As shown in FIGS. 6 and 7, the centre of the base plate 22 of impeller 20 is provided with a first shaft hole 28, the centre of the rotor 34 is provided with a second shaft hole 347. Two ends of the rotating shaft 40 are respectively penetrated in the first shaft hole 28 and the second shaft hole 347, and are fixedly connected to the rotor 34 and the impeller 20 by bonding, snapping, welding, adhesive method, etc., so that the rotor 34 and the impeller 20 can rotate synchronously.

Figure 4:
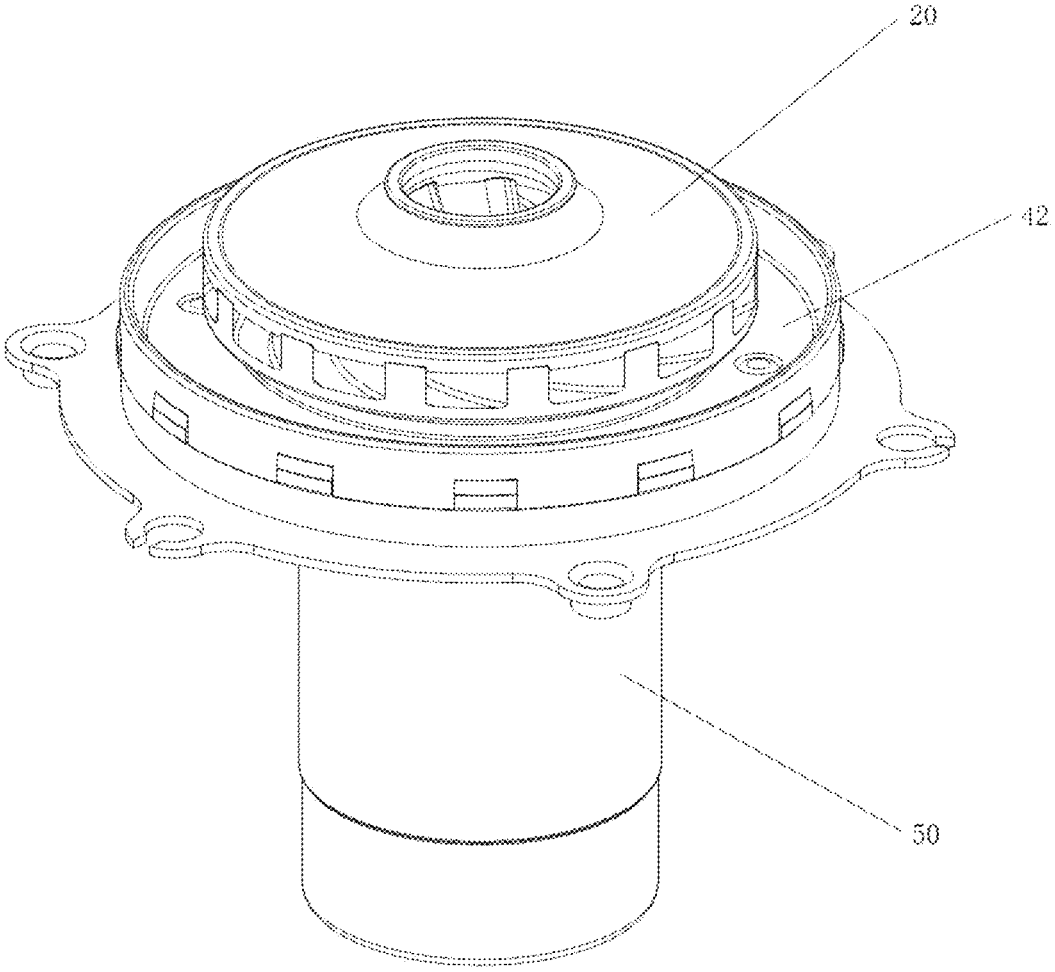
FIG. 4 is the assembled view of the motor rotor, impeller and sleeve of the fluid pump of FIG. 2.
Figure 5:
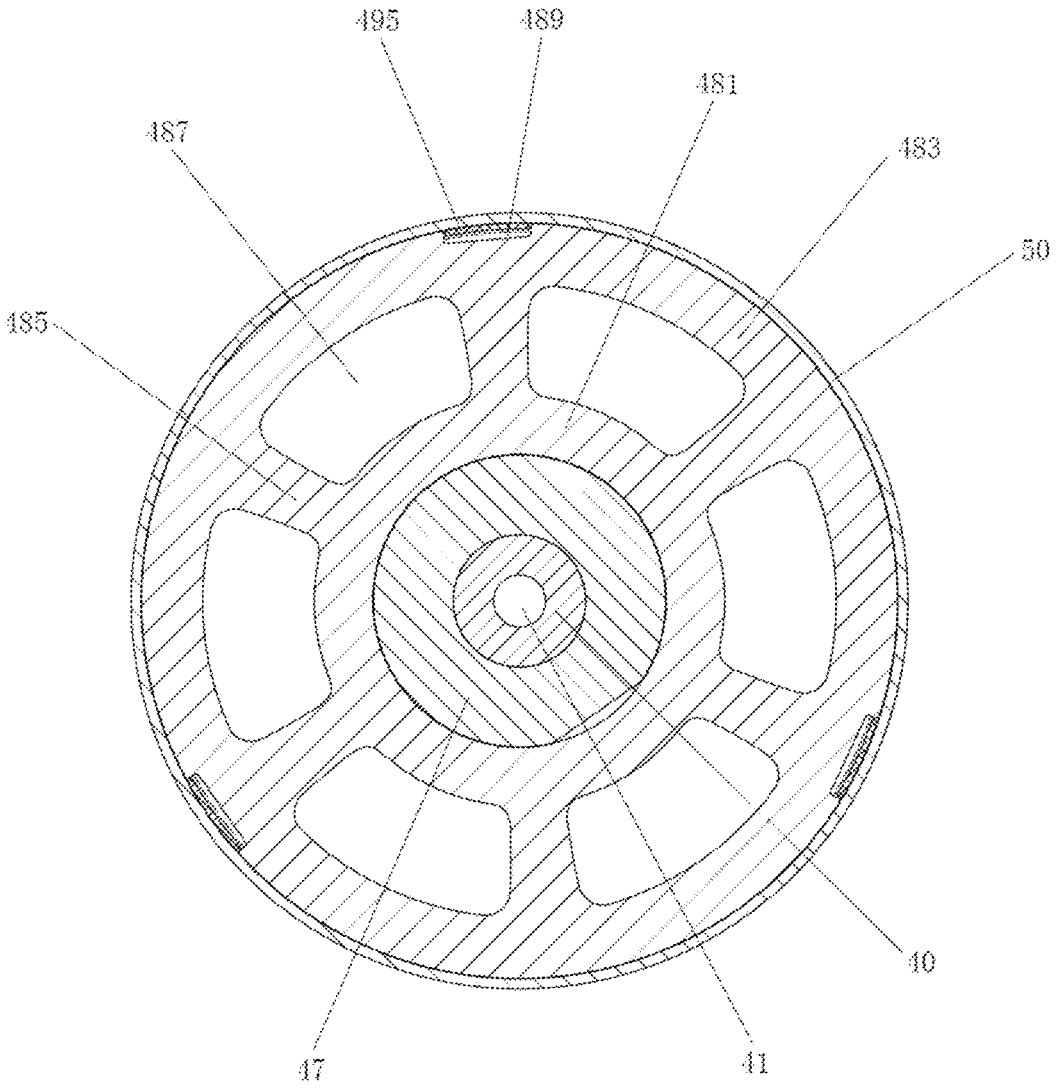
FIG. 5 is a radial cross-sectional view of FIG. 4.

As shown in FIGS. 3-4, a sleeve 50 is arranged in the pump casing 10, and the sleeve 50 is made of materials such as stainless steel, and is a cylindrical structure that one end is open and one end is closed as a whole, wherein the open end 52 faces the impeller 20, and the closed end 54 is relatively far away from the impeller 20. The sleeve 50 divides the internal space of the pump casing 10 into two relatively independent spaces: a first space 16 and a second space 18, wherein the first space 16 is used to accommodate the rotor 34 and the impeller 20, and the second space 18 is used to accommodate the stator 32. The stator 32 is separated from the rotor 34 and the impeller 20 by the sleeve 50, the fluid flows only in the first space 16, and the fluid is effectively avoided from eroding the stator 32 in the second space 18 to affect the electrical safety of the motor 30 and even the fluid pump 100.

As shown in FIGS. 3 and 6-7, the two ends of the rotating shaft 40 are respectively provided with a first bearing assembly 42 and a second bearing assembly 44, wherein the first bearing assembly 42 is arranged at the open end 52 of the sleeve 50, and the second bearing assembly 44 is arranged at the closed end 54 of the sleeve 50.

The first bearing assembly 42 includes a first bearing 45 and a first bearing holder 46 for mounting the first bearing 45. The first bearing 45 is arranged in the centre of the first bearing holder 46 and has a first bearing hole therein for accommodating a first end (such as a top end) of the rotating shaft 40. The second bearing assembly 44 includes a second bearing 47 and a second bearing holder 48 for mounting the second bearing 47. The second bearing 47 is arranged in the centre of the second bearing holder 48 and has a second bearing hole therein for accommodating a second end (such as a bottom end) of the rotating shaft 40. The first bearing 45 and the second bearing 47 are used to support the rotation of the rotating shaft 40, rotor 34 and impeller 20, and they can be sliding bearings, ball bearings, bushings, etc, the type of the two can be the same or different.

In this application, the rotating shaft 40 is fixedly connected to the impeller 20 and the rotor 34, and they rotate synchronously. By arranging the first bearing 45 and the second bearing 47, effective support is provided at both ends of the rotating shaft 40. When the rotating shaft 40 rotates synchronously with the impeller 20 and the rotor 34, even if the impeller 20 experiences uneven forces in the circumferential direction, the rotating shaft 40 can always be kept in a coaxial state with the stator 32, and then the rotor 34 and the impeller 20 are kept in the coaxial state with the stator 32. It avoids the deflection of the rotating shaft 40 that could affect the stability and smoothness of the rotation of the rotor 34 and the impeller 20, and it also avoids resulting stresses that could lead to component damage, ensuring the stability and safety of the operation of the fluid pump 100 of the present application, reducing noise generation, and prolonging its service life.

As shown in FIG. 6, the open end 52 of the sleeve 50 extends radially outward to form a first flange 56. The first bearing holder 46 is an overall flat disc-shaped structure and is stacked on the outer side of the first flange 56 of the sleeve 50.

Preferably, the first flange 56 forms protrusions 57 that convex outward towards the first bearing holder 46, such as convex posts, convex bars, etc. The first bearing hold 46 defines recesses 461 that concave at the positions corresponding to the protrusions 57, such as through holes, grooves, etc. During assembly, the protrusions 57 of the sleeve 50 are aligned with the recesses 461 of the first bearing holder 46 respectively, allowing for a complementary fit that provides circumferential positioning of the first bearing holder 46 and the sleeve 50. In other embodiments, protrusions can also be arranged on the first bearing holder 46, recesses can be arranged on the first flange 56 correspondingly, circumferential positioning can also be achieved through complementary fitting. Of course, the first bearing holder 46 and the sleeve 50 can also be positioned circumferentially by other means, such as snap fits, etc.

In some embodiments, the outer edge of the first flange 56 of the sleeve 50 is bent and extended to form an annular flange 58, and a distal end of the flange 58 is further bent and extended to form a second flange 59. The second flange 59 extends radially outward from the sleeve 50 and is axially sandwiched between the pump casing cover 10*b* and the stator shell 321, as shown in FIG. 3. Preferably, sealing members, such as sealing rings, etc., are respectively arranged between the second flange 59 of sleeve 50 and the pump casing cover 10*b*, and between the second flange 59 and the stator shell 321, to ensure the seal of the whole fluid pump 100. In this way, the fluid in the first space 16 can be avoided from leaking to the fluid pump 100, and moisture, dust and the like in the external environment can also be avoided from entering the second space 18 of the fluid pump 100, and the safety of use is guaranteed.

In the illustrated embodiment, the stator 32 is assembled on the pump casing body 10*a* and partially extends outside of the pump casing body 10*a*. The pump casing cover 10*b* is stacked on the stator shell 321, and the second flange 59 of the sleeve 50 is sandwiched between the pump casing cover 10*b* and the stator shell 321. Fasteners, such as screws, etc., pass through the pump casing body 10*a*, the stator shell 321 and the second flange 59, and then are screwed into with the pump casing cover 10*b*. It should be understood that the pump casing 10 generally refers to the outermost housing structure of the whole pump, and the stator shell 321 can also be regarded as a part of the pump casing 10.

The first bearing holder 46 further divides the first space 16 into a first subspace 161 and a second subspace 163, wherein the first subspace 161 is a space between the pump casing cover 10*b* and the first bearing holder 46, corresponding to the open end 52 of the sleeve 50, for accommodating the impeller 20. The second subspace 163 is an internal space of the sleeve 50, for accommodating the rotor 34. The stator 32 is arranged in the second space 18, wherein the stator core 323 surrounds the sleeve 50, and the circuit board 327 is in contact with the closed end 54 of the sleeve 50. During the operation of the motor 30, the stator 32, especially the circuit board 327 of stator 32 will generate a large amount of heat, and the heat can be conducted to the sleeve 50 for dissipation.

The first bearing holder 46 is provided with through holes 463 at positions corresponding to the second subspace 163, connecting the first subspace 161 and the second subspace 163. The number of the through holes 463 may be single or plural, extending axially through the first bearing holder 46, allowing fluid to flow from the first subspace 161, where the impeller 20 is located, to the second subspace 163 inside the sleeve 50, to carry out heat exchange with the sleeve 50, and dissipate heat for the stator 32, in particular the circuit board 327 of the stator 32.

A flow passage 41 is formed in the rotating shaft 40, the number of the flow passage 41 may be single or plural, extending axially along the rotating shaft 40 and connecting the second subspace 163 and the first subspace 161, so that the fluid after heat absorption can flow back from the second subspace 163 to the first subspace 161, and finally is discharged to the outside through the outlet 14 under the effect of the impeller 20. In this embodiment, the bottom end of the rotating shaft 40 is spaced from the closed end 54 of the sleeve 50, and the top end is located between the cover plate 24 and the base plate 22 of the impeller 20, that is, aligning with the position of the impeller 20. The flow passage 41 extends through both axial ends of the rotating shaft 40, and the fluid in the second subspace 163 can enter the flow passage 41 from the bottom end of the rotating shaft 40, and then flows towards the space among the blades 26 from the top end of the rotating shaft 40, and returns to the first subspace 161.

In some embodiments, either end of the flow passage 41 may also be bent to extend through a circumferential outer wall of the rotating shaft 40, allowing fluid to flow approximately radially in and out of the flow passage 41.

As shown in FIG. 6 and FIG. 7, the second bearing holder 48 includes an inner ring 481 located in its centre, an outer ring 483 arranged around the inner ring 481, and a plurality of ribs 485 connected between the inner ring 481 and the outer ring 483. Wherein, an assembly hole 482 is defined in a centre of the inner ring 481 for installing the second bearing 47. The outer diameter of the outer ring 483 is approximately equal to the inner diameter of the sleeve 50 or slightly smaller than the inner diameter of the sleeve 50, so that the second bearing holder 48 can be conveniently assembled into the sleeve 50 and preliminarily positioned with the sleeve 50. The plurality of ribs 485 are arranged at intervals around the circumference of the second bearing holder 48, forming channels 487 between adjacent ribs 485, so that fluid can flow more smoothly through the second bearing holder 48 to the closed end 54 of the sleeve 50.

In this embodiment, the axial height of the outer ring 483 is greater than the axial height of the inner ring 481, and the outer ring 483 extends outward a certain length in the axial direction towards the closed end 54 of the sleeve 50 relative to the inner ring 481. After assembly, the outer ring 483 axially abuts against the closed end 54 of the sleeve 50, and the inner ring 481 is axially spaced from the closed end 54 of the sleeve 50. Preferably, ends of the rotating shaft 40 and the inner ring 481 facing the closed end 54 of the sleeve 50 are approximately flush, allowing the inner ring 481 and the rotating shaft 40 to be spaced a certain height in the axial direction from the closed end 54 of the sleeve 50, so that the channels 487 can communicate with the flow passage 41 of the rotating shaft 40, and fluid can flow back through the second bearing holder 48 to the flow passage 41 of the rotating shaft 40.

In this embodiment, the second bearing assembly 44 also includes a fixing member 49, which is used to secure the second bearing holder 48 within the sleeve 50.

Specifically, the fixing member 49 includes a first ring part 491, a second ring part 493, and a positioning part 495. The first ring part 491 is in contact with the inner circumferential wall of the sleeve 50, and the two can be fixedly connected by methods such as welding or tight/interference fitting. The second ring part 493 extends radially inward from the first ring part 491 and abuts against the second bearing holder 48 axially, so that the second bearing holder 48 is sandwiched between the second ring part 493 and the closed end 54 of the sleeve 50 and is positioned axially. The positioning part 495 extends axially from the first ring part 491 towards the second bearing holder 48, and the outer wall of the second bearing holder 48 is provided with a positioning groove 489 that engages with the positioning part 495. The second bearing holder 48 is circumferentially positioned through the cooperation of the positioning part 495 and the positioning groove 489.

Specifically, the positioning part 495 can be a positioning piece, and the quantity can be one or multiple. Preferably, the quantity of the positioning part 495 is multiple, distributed at intervals along the circumferential direction of the fixing member 49. Each positioning part 495 extends integrally from the first ring part 491 towards the second bearing holder 48. The second bearing holder 48 has multiple positioning grooves 489 on its outer wall, and each positioning groove 489 extends a certain length in the axial direction of the second bearing holder 48. During assembly, the positioning parts 495 of the fixed member 49 are aligned and inserted into the positioning grooves 489 of the second bearing holder 48 one by one, until the second ring part 493 abuts against an end face of the second bearing holder 48. Thereafter, the first ring part 491 is fixedly connected to the circumferential inner wall of the sleeve 50, securing the second bearing holder 48 within the sleeve 50. To facilitate the arrangement of the positioning parts 495, the second ring part 493 may have openings at positions corresponding to the positioning parts 495, making the second ring part 493 appear as multiple arc-shaped pieces.

In other embodiments, the second ring part 493 can abut axially against the second bearing holder 48 in other forms, for example, the second ring part 493 and the first ring part 491 are on the same circumference, directly abutting or inserted into the top of the second bearing holder 48. In other embodiments, the positioning portion 495 can also extend radially from the first ring part 491 or the second ring part 493 and be inserted into the second bearing holder 48, thereby positioning the second bearing holder 48 in the circumferential direction.

When the fluid pump 100 of this application operates, fluid enters the pump casing 10 through the inlet 12. The impeller 20 rotates to drive the fluid to flow out of the pump casing 10 from the outlet 14. During the rotation of the impeller 20, the first bearing assembly 42 and the second bearing assembly 44 provide effective support for both ends of the rotating shaft 40, preventing uneven circumferential forces on the impeller 20, which could cause the rotating shaft 40 to deflect, thus ensuring the stability and safety of the operation of the rotor 34 and the impeller 20. A small amount of fluid enters the sleeve 50 through the through holes 463 on the first bearing holder 46, and then returns to the impeller 20 via the flow passage 41 of the rotating shaft 40. During this process, heat exchange occurs between the fluid and the sleeve 50, taking away the heat from the stator 32, ensuring that the motor 30 operates at an appropriate temperature to prevent failures and enhance electrical safety.

It should be noted that the above embodiments only express the preferred embodiments of this application, and the descriptions are relatively specific and detailed, but should not be understood as a limitation on this application. It should be pointed out that for an ordinary skilled person in the field, several modifications and improvements can be made without departing from the concept of this application, such as combining different features from various embodiments, and these should all fall within the protection scope of this application.

The invention claimed is:

1. A fluid pump comprises:

a pump casing comprising a sleeve arranged therein and dividing an internal space of the pump casing into a first space and a second space;

an impeller arranged in the pump casing; and a motor for driving the impeller to rotate in the pump casing, the motor comprising a stator and a rotor fixedly connected to the impeller through a rotating shaft;

wherein the sleeve is a cylindrical structure with an open end and a closed end, the rotor, the rotating shaft and the impeller are movably arranged in the first space, the stator is fixedly arranged in the second space, a first bearing assembly and a second bearing assembly are respectively arranged at two ends of the rotating shaft, and the second bearing assembly is positioned at the closed end of the sleeve distal from the impeller and fixedly connected to the sleeve by a fixing member, the second bearing assembly comprises a second bearing holder and a second bearing, the second bearing holder comprises an inner ring and an outer ring surrounding the inner ring, the second bearing is arranged within the inner ring.

2. The fluid pump of claim 1, wherein the inner ring is axially spaced from the closed end of the sleeve, and the outer ring axially abuts against the closed end of the sleeve.

3. The fluid pump of claim 2, wherein the second bearing holder further comprises a plurality of ribs connected between the inner ring and the outer ring, the ribs are arranged at intervals in the circumferential direction, forming channels between adjacent ribs.

4. The fluid pump of claim 2, wherein the rotating shaft is axially spaced from the closed end of the sleeve, and an axially extending flow passage is formed in the rotating shaft.

5. The fluid pump of claim 4, wherein one of the two ends of the rotating shaft and the inner ring facing the closed end of the sleeve are substantially flush.

6. The fluid pump of claim 1, wherein the fixing member is fixedly connected to an inner circumferential wall of the sleeve and positions the second bearing holder at the closed end of the sleeve.

7. The fluid pump of claim 4, wherein the fixing member comprises a first ring part and a second ring part, the first ring part is fixedly connected to the inner circumferential wall of the sleeve, and the second bearing holder is axially sandwiched between the second ring part and the closed end of the sleeve.

8. The fluid pump of claim 7, wherein the fixing member further comprises at least one positioning piece extending axially from the first ring part towards the second bearing holder, an outer wall of the second bearing holder is provided with at least one axially extending positioning groove, the at least one positioning piece engages in the at least one positioning groove, to circumferentially position the second bearing holder.

9. The fluid pump of claim 7, wherein the first ring part is fixedly connected to the inner circumferential wall of the sleeve through interference fitting or by welding.

10. The fluid pump of claim 8, wherein the numbers of the positioning piece and the positioning groove are multiple, the multiple positioning pieces and positioning grooves are respectively distributed at intervals along circumferential directions of the first ring part and the second bearing holders.

11. The fluid pump of claim 1, wherein the first bearing assembly comprises a first bearing holder and a first bearing disposed within the first bearing holder, the first bearing holder is stacked on an outer side of the open end of the sleeve, dividing the first space into a first subspace and a second subspace, the impeller is arranged in the first subspace, and the rotor is arranged in the second subspace, the first bearing holder is provided with through holes, which communicates the first subspace with the second subspace.

12. A fluid pump comprises:

a pump casing comprising a sleeve arranged therein, the sleeve comprising an open end and a closed end and dividing an internal space of the pump casing into a first space and a second space;

an impeller rotatably arranged in the first space adjacent to the open end of the sleeve; and a motor for driving the impeller to rotate, the motor comprising a stator fixedly arranged in the second space, and a rotor rotatably arranged in the first space and fixedly connected to the impeller through a rotating shaft, the rotating shaft comprising an axial extending flow passage;

wherein two ends of the rotating shaft are respectively supported by a first bearing assembly and a second bearing assembly, the second bearing assembly is positioned at the closed end of the sleeve and defines channels communicating with the flow passage and the first space, and wherein the second bearing assembly comprises a second bearing holder and a second bearing, the second bearing holder comprises an inner ring and an outer ring surrounding the inner ring, the second bearing is arranged within the inner ring, the inner ring is axially spaced from the closed end of the sleeve, and the outer ring axially abuts against the closed end of the sleeve.

13. The fluid pump of claim 12, wherein the inner ring is connected to the outer ring by a plurality of ribs, each two adjacent ribs define one of the channels therebetween.

14. The fluid pump of claim 12, wherein the rotating shaft is axially spaced from the closed end of the sleeve, one of the two ends of the rotating shaft and the inner ring facing the closed end of the sleeve are substantially flush.

15. The fluid pump of claim 12, wherein a fixing member is fixedly connected to an inner circumferential wall of the sleeve and secures the second bearing holder at the closed end of the sleeve.

16. The fluid pump of claim 15, wherein the fixing member comprises a first ring part and a second ring part, the first ring part is fixedly connected to the inner circumferential wall of the sleeve, and the second bearing holder is axially sandwiched between the second ring part and the closed end of the sleeve.

17. The fluid pump of claim 16, wherein the fixing member further comprises at least one positioning piece extending axially from the first ring part towards the second bearing holder, an outer wall of the second bearing holder is provided with at least one axially extending positioning groove, the at least one positioning piece engages in the at least one positioning groove, to circumferentially position the second bearing holder.

* * * * *